US005626998A

United States Patent [19]

Grabowski et al.

[11] Patent Number: 5,626,998

[45] Date of Patent: May 6, 1997

[54] PROTECTIVE OVERCOATING FOR IMAGING MEMBERS

[75] Inventors: Edward F. Grabowski; Anita P. Lynch, both of Webster; Emery G. Tokoli, deceased, late of Rochester, all of N.Y., by John F. Tokoli, executor

[73] Assignee: Xerox Corporation, Stamford, Conn.

[21] Appl. No.: 476,927

[22] Filed: Jun. 7, 1995

[51] Int. Cl.[6] ..... G03G 5/14

[52] U.S. Cl. ..... 430/67; 430/132

[58] Field of Search ..... 430/66, 67, 132

[56] References Cited

U.S. PATENT DOCUMENTS

| | | | |
|---|---|---|---|
| 4,260,671 | 4/1981 | Merrill | 430/64 |
| 4,341,455 | 7/1982 | Fedder | 355/3 |
| 4,390,609 | 6/1983 | Wiedemann | 430/58 |
| 4,565,760 | 1/1986 | Schank | 430/66 |
| 4,743,492 | 5/1988 | Wilson, II | 428/216 |
| 4,784,928 | 11/1988 | Kan et al. | 430/58 |
| 5,055,366 | 10/1991 | Yu et al. | 430/58 |
| 5,096,796 | 3/1992 | Mammino et al. | 430/67 |
| 5,119,140 | 6/1992 | Berkes et al. | 355/273 |
| 5,120,628 | 6/1992 | Mammino et al. | 430/59 |
| 5,233,396 | 8/1993 | Simms et al. | 355/275 |
| 5,356,668 | 10/1994 | Paton et al. | 427/2.25 |

FOREIGN PATENT DOCUMENTS

| | | |
|---|---|---|
| 59-159 | 1/1984 | Japan . |

OTHER PUBLICATIONS

Teflon AF Amorphous Fluoropolymer Brochure, DuPont Company, May 1989.

Telfon AF Amorphous Fluoropolymer Brochure, DuPont Company, Dec. 1989.

*Primary Examiner*—John Goodrow

*Attorney, Agent, or Firm*—Oliff & Berridge

[57] ABSTRACT

An overcoating for an electrophotographic imaging member includes an amorphous fluoropolymer overcoating layer.

24 Claims, 4 Drawing Sheets

PROTECTIVE OVERCOATING FOR IMAGING MEMBERS

BACKGROUND OF THE INVENTION

This invention relates to imaging members and more particularly, to an improved overcoating layer for an imaging member.

In electrophotography, an electrophotographic plate, drum, belt or the like ("plate") containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support, such as paper. This imaging process may be repeated many times with reusable photoconductive insulating layers.

An electrophotographic imaging member may be provided in a number of forms. For example, the imaging member may be a homogeneous layer of a single material, such as vitreous selenium, or it may be a composite layer containing a photoconductor and another material. One type of composite imaging member comprises a layer of finely divided particles of a photoconductive inorganic compound dispersed in an electrically insulating organic resin binder. U.S. Pat. No. 4,265,990 discloses a layered photoreceptor having separate photogenerating and charge transport layers. The photogenerating layer is capable of photo-generating holes and injecting the photogenerated holes into the charge transport layer.

Other composite imaging members have been developed having numerous layers which may be highly flexible and exhibit predictable electrical characteristics within narrow operating limits to provide excellent images over many thousands of cycles. One type of multilayered photoreceptor that has been employed as a belt in electrophotographic imaging systems comprises a substrate, a conductive layer, a hole blocking layer, an adhesive layer, a charge generating layer, and a charge transport layer. This photoreceptor may also comprise additional layers such as an anti-curl back coating and an overcoating layer.

Another form of imaging member is an image-bearing dielectric member useful in ionography. Generally, ionographic image members include a support drum, belt or plate having a dielectric film thereon as an electrostatic image-bearing dielectric member. Ions or charged particles are generated by means of an ion generator to form an electrostatic image on the surface of the dielectric member.

Imaging members are generally exposed to repetitive cycling, which subjects exposed layers of imaging devices to abrasion, chemical attack, heat and multiple exposure to light. This repetitive cycling leads to a gradual deterioration in the mechanical and electrical characteristics of the exposed layers. For example, repetitive cycling has adverse effects on exposed portions of the imaging member. Attempts have been made to overcome these problems. However, the solution of one problem often leads to additional problems.

In electrophotographic imaging devices, the charge transport layer may comprise a high loading of a charge transport compound dispersed in an appropriate binder. The charge transport compound may be present in an amount greater than about 35% based on weight of the binder. For example, the charge transport layer may comprise 50% of a charge transport compound in about 50% binder. A high loading of charge transport compound appears to drive the chemical potential of the charge transport layer to a point near the metastable state, which is a condition that induces crystallization, leaching and stress cracking when the charge transport layer is placed in contact with a chemically interactive solvent, liquid ink or liquid developer. Photoreceptor functionality may be completely destroyed when a charge transport layer having a high loading of a charge transport molecule is contacted with liquid ink. It is thus desirable to eliminate charge transport molecule crystallization, leaching and solvent-stress charge transport layer cracking.

Another problem in multilayered belt imaging systems includes cracking in one or more critical imaging layers during belt cycling over small diameter rollers. Cracks developed in the charge transport layer during cycling are a frequent phenomenon and most problematic because they can manifest themselves as print-out defects which adversely affect copy quality. Charge transport layer cracking has a serious impact on the versatility of a photoreceptor and reduces its practical value for automatic electrophotographic copiers, duplicators and printers.

Another problem encountered with electrophotographic imaging members is corona species induced deletion in print due to degradation of the charge transport molecules by chemical reaction with corona species. During electrophotographic charging, corona species are generated. Corona species include, for example, ozone, nitrogen oxides, acids and the like.

A number of overcoating layers have been proposed for various purposes. U.S. Pat. No. 4,784,928 to Kan et al. discloses a reusable electrophotographic element comprising first and second charge transport layers. The second charge transport layer has irregularly shaped fluorotelomer particles, an electrically nonconductive substance, dispersed in a binder resin. The second charge transport layer allows for toner to be uniformly transferred to a contiguous receiver element with minimal image defects.

U.S. Pat. No. 4,260,671 to Merrill discloses various polycarbonate overcoats which provide an increased resistance to solvents and abrasions.

U.S. Pat. No. 4,390,609 to Wiedemann discloses a protective transparent cover layer made of an abrasion resistant binder composed of polyurethane resin and a hydroxyl group containing polyester or polyether, and a polyisocyanate.

U.S. Pat. No. 5,055,366 to Yu et al., the entire disclosure of which is incorporated herein by reference, discloses an overcoat layer containing a film forming binder material or polymer blend doped with a charge transport compound.

U.S. Pat. No. 4,565,760 to Schank discloses a release protective coating including a dispersion of colloidal silica and a hydroxylated silesquixone in an alcoholic medium. The overcoating is of a thickness of from 0.2 microns to about 1.5 microns.

U.S. Pat. No. 5,096,796 to Mammino et al. discloses an overcoat layer of acrylate, polycarbonate, polyester, polyurethane, acrylic homopolymer or copolymer.

U.S. Pat. No. 5,120,628 to Mammino et al. discloses an overcoating containing an insulating, film forming continuous phase having charge transport molecules and copper (I) compounds.

Japanese Patent Document 59-159 discloses a protective layer containing copper oxide dispersed in an amount from 10–60 wt. % of a binder resin. The thickness of the protective layer is 0.5–10 microns.

U.S. Pat. No. 4,473,492 to Wilson discloses a primer-topcoat system for various substrates. A primer of a mixture of an acrylic resin and an epoxy compound derived from the condensation product of epichlorohydrin and bisphenol A or bisphenol AF is provided with a topcoat of polyvinyl fluoride. The use of the primer-topcoat system is not disclosed as being for electrophotographic or ionographic applications.

There continues to be a need for improved overcoatings for imaging members, which overcoatings will provide better protection for the charge transport layer from adverse mechanical- and chemical-induced effects.

SUMMARY OF THE INVENTION

The invention provides a protective overcoating layer for an imaging member, which reduces wear on the imaging member. The invention also reduces the friction of machine parts such as a cleaning blade, on an imaging member. The invention also prevents formation of comets on an imaging member. The invention further seals an imaging member from the effects of humidity, ozone and other chemicals that may adversely affect performance of the imaging member.

The present invention overcomes the shortcomings of the prior art by providing a protective overcoating for an imaging member. The overcoating comprises an overcoat layer including an amorphous fluoropolymer, preferably with a primer.

BRIEF DESCRIPTION OF THE DRAWINGS

A more complete understanding of the invention can be obtained by reference to the accompanying Figures.

DETAILED DESCRIPTION OF PREFERRED EMBODIMENTS

Figure 1:
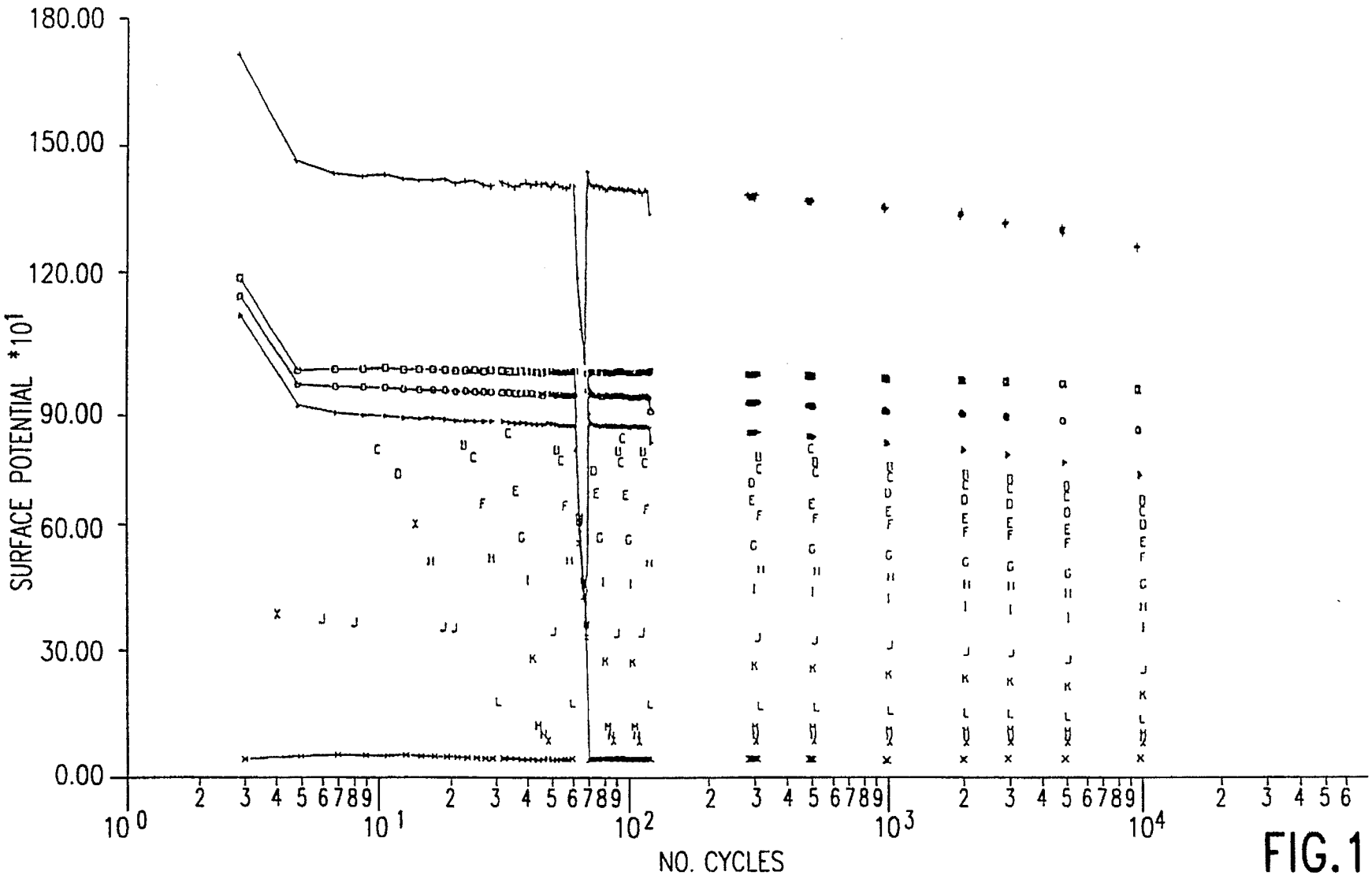
FIG. 1 is a graph of the surface potential of an imaging member according to Comparative Example 1.

The protective overcoating of the present invention may be applied to an imaging member having any of a number of configurations. For example, an electrophotographic imaging member may comprise at least one imaging layer capable of retaining an electrostatic latent image, and a supporting substrate layer having an electrically conductive surface. At least one imaging layer may comprise a charge transport layer and a charge generating layer. The imaging device may further comprise additional layers such as a blocking layer, an adhesive layer, and an anti-curl layer.

A ground strip may be provided adjacent the charge transport layer at an outer edge of the imaging member. See U.S. Pat. No. 4,664,995. The ground strip is provided adjacent to the charge transport layer so as to provide grounding contact with a grounding device during electrophotographic processes.

A description of the layers of an electrophotographic imaging member follows.

The Supporting Substrate

The supporting substrate may be opaque or substantially transparent and may comprise numerous suitable materials having the required mechanical properties. The substrate may further be provided with an electrically conductive surface. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes and the like. The electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E. I. du Pont de Nemours & Co., or Melinex available from ICI Americas Inc. Alternatively, the substrate may be a rigid drum.

The thickness of the substrate layer depends on numerous factors, including mechanical performance and economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness for example less than 50 micrometers, provided there are no adverse effects on the final photoconductive device.

The Electrically Conductive Ground Plane Layer

The electrically conductive ground plane layer may be an electrically conductive metal layer which may be formed, for example, on the substrate by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be between about 20 Å to about 750 Å, and more preferably from about 50 Å, to about 200 Å for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Å and about 9000 Å, for a conductive carbon black dispersed in a plastic binder as an opaque conductive layer.

The Charge Blocking Layer

After deposition of the electrically conductive ground plane layer, the charge blocking layer may be applied thereto. Charge blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryrol, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl, di(dodecylbenzene sulfonyl) titanate, isopropyl di(4aminobenzoyl)isostearoyl titanate, isopropyl tri (Nethylaminoethylamino)titanate, isopropyl trianthranil titanate, isopropyl, tri(N,N-dimethylethylamino)titanate, titanium-4-amino benzene sulfonate oxyacetate, titanium 4aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gammaaminopropyl) methyl diethoxysilane, as disclosed in U.S. Pat. Nos. 4,338,387, 4,286,033 and 4,291,110. The imaging member is preferably prepared by depositing on the metal oxide layer of a metal conductive layer, a coating of an aqueous solution of the hydrolyzed aminosilane at a pH between about 4 and about 10, drying the reaction product layer to form a siloxane film and applying an adhesive layer, and thereafter applying electrically operative layers, such as a photogenerator layer and a hole transport layer, to the adhesive layer.

The hole blocking layer should be continuous and have a thickness of less than about 0.5 micrometer because greater thicknesses may lead to undesirable high residual voltage. A hole blocking layer of between about 0.005 micrometer and about 0.3 micrometer is preferred because charge neutralization after the exposure step is facilitated and optimum electrical performance is achieved. A thickness of between about 0.03 micrometer and about 0.06 micrometer is preferred for hole blocking layers for optimum electrical behavior. The blocking layer may be applied by any suitable conventional technique such as spraying, dip coating, draw bar coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Adhesive Layer

In most cases, intermediate layers between the injection blocking layer and the adjacent charge generating or photogenerating layer may be desired to promote adhesion. For example, an adhesive layer may be employed. If such layers are utilized, they preferably have a dry thickness between about 0.001 micrometer to about 0.2 micrometer. Typical adhesive layers include film-forming polymers such as copolyester, du Pont 49,000 resin (available from E. I. du Pont de Nemours & Co.), vitel-PE100 (available from Goodyear Rubber & Tire Co.), polyvinylbutyral, polyvinylpyrolidone, polyurethane, polymethyl methacrylate, and the like.

The Charge Generating Layer

Any suitable charge generating (photogenerating) layer may be applied to the adhesive layer. Examples of photogenerating layers include inorganic photoconductive particles such as amorphous selenium, trigonal selenium, and selenium alloys selected from the group consisting of selenium-tellurium, selenium-tellurium-arsenic, selenium arsenide and phthalocyanine pigment such as the X-form of metal free phthalocyanine described in U.S. Pat. No. 3,357,989, metal phthalocyanines such as vanadyl phthalocyanine, hydroxy gallium phthalocyanine, and copper phthalocyanine, dibromoanthanthrone, squarylium, quinacridones available from du Pont under the tradename Monastral Red, Monastral Violet and Monastral Red Y, Vat orange 1 and Vat orange 3 (trade names for dibromo anthanthrone pigments), benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like, dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639. Other suitable photogenerating materials known in the art may be utilized, if desired. Charge generating layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light.

Any suitable polymeric film forming binder material may be employed as the matrix in the photogenerating binder layer. Typical polymeric film forming materials include those described, for example, in U.S. Pat. No. 3,121,006.

The photogenerating composition or pigment is present in the resinous binder composition in various amounts, generally from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer generally ranges in thickness from about 0.1 micrometer to about 5.0 micrometers, preferably from about 0.3 micrometer to about 3 micrometers. The photogenerating layer thickness is related to binder content. Higher binder content compositions generally require thicker layers for photogeneration. Thickness outside these ranges can be selected providing the objectives of the present invention are achieved. Any suitable and conventional technique may be utilized to mix and thereafter apply the photogenerating layer coating mixture to the previously dried adhesive layer. Typical application techniques include spraying, dip coating, roll coating, wire wound rod coating, and the like. Drying of the deposited coating may be effected by any suitable conventional technique such as oven drying, infrared radiation drying, air drying, vacuum drying, and the like, to remove substantially all of the solvents utilized in applying the coating.

The Active Charge Transport Layer

The active charge transport layer may comprise any suitable transparent organic polymer or non-polymeric material capable of supporting the injection of photogenerated holes and electrons from the charge generating layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Å to 9000 Å. The charge transport layer is substantially transparent to radiation in a region in which the photoconductor is to be used. It is comprised of a material which supports the injection of photogenerated holes from the charge generating layer. The active charge transport layer is normally transparent when exposure is effected therethrough to ensure that most of the incident radiation is utilized by the underlying charge generating layer. When used with a transparent substrate, imagewise exposure or erase may be accomplished through the substrate with all light passing through the substrate. In this case, the active charge transport material need not transmit light in the wavelength region of use. The charge transport layer in conjunction with the charge generating layer is an insulator to the extent that an electrostatic charge placed on the charge transport layer is not conducted in the absence of illumination.

The active charge transport layer may comprise activating compounds dispersed in normally electrically inactive polymeric materials making these materials electrically active. These compounds may be added to polymeric materials which are incapable of supporting the injection of photogenerated holes and incapable of allowing the transport of these holes. An especially preferred transport layer employed in multilayer photoconductors comprises from about 25 percent to about 75 percent by weight of at least one charge transporting aromatic amine compound, and about 75 percent to about 25 percent by weight of a polymeric film forming resin in which the aromatic amine is soluble.

Any suitable inactive resin binder in which the charge transport molecules are soluble or molecularly dispersed in methylene chloride or other suitable solvent may be employed. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight of from about 35,000 to about 40,00 available as Lexan 145 from General Electric Company; poly(4,4'-isopropylidene-diphenylene carbonate) with a molecular weight of from about 40,000 to about 45,000, available as Lexan 141 from General Electric Company; a polycarbonate resin having a molecular weight of from about 50,000 to about 100,000, available as Makrolon from Farben Fabricken Bayer A.G.; a polycarbonate resin having a molecular weight of from about 20,000 to about 50,000 available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

The thickness of the charge transport layer may range between about 10 micrometers and about 50 micrometers, but preferably between about 20 micrometers and about 35 micrometers. A range from about 23 micrometers to about 31 micrometers is optimum.

The Ground Strip

The ground strip may comprise a film forming polymer binder and electrically conductive particles. Cellulose may be added to disperse the electrically conductive particles. Any suitable electrically conductive particles may be used in the electrically conductive ground strip layer of this invention. The ground strip may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The thickness of the ground strip layer is generally from about 7 micrometers to about 40 micrometers. A preferred thickness may range from about 13 micrometers to about 28 micrometers, and more preferably from about 16 micrometers to about 24 micrometers.

The Anti-Curl Layer

The optional anti-curl layer may comprise organic polymers or inorganic polymers that are electrically insulating or slightly semi-conductive. The anti-curl layer provides flatness and/or abrasion resistance. The anti-curl layer may be formed at the back side of the substrate, opposite to the imaging layers. The anti-curl layer may comprise a film forming resin and an adhesion promoter polyester additive. Examples of film forming resins include polyacrylate, polystyrene, poly(4,4'isopropylidene diphenyl carbonate), 4,4'-cyclohexylidene diphenyl polycarbonate, and the like. Typical adhesion promoters used as additives include 49,000 (du Pont), Vitel PE-100, Vitel PE-200, Vitel-PE-307 (Goodyear), and the like. Usually from about 1 to about 5 weight percent adhesion promoter is selected for film forming resin addition. The thickness of the anti-curl layer is from about 3 micrometers to about 35 micrometers, and preferably about 14 micrometers.

The Overcoating Layer

In the invention, a protective overcoat is provided over the imaging member. The protective overcoat of the present invention comprises an overcoat layer, preferably with a primer.

An overcoat layer is applied onto the imaging member. The overcoat layer includes an amorphous fluoropolymer. Examples of amorphous fluoropolymer include the TEFLON AF (TM) amorphous fluoropolymers available from E. I. du Pont de Nemours & Co., Specialty Polymers Division, Wilmington, Del. TEFLON AF 1600 and 2400 (TM) are fluorinated (ethylenic/cyclo oxyaliphatic substituted ethylenic) copolymers. More specifically, these amorphous fluoropolymers are copolymers of perfluoro-2,2-dimethyl-1,3-dioxole and tetrafluoroethylene. The amorphous fluoropolymers have a tensile modulus of about 950 MPa to about 2150 MPa measured using ASTM method D638; a refractive index of about 1.29 to about 1.31, measured using ASTM method D542; and a melt viscosity of about 540 Pa.sec to about 2660 Pa.sec measured at 250° C., 100 sec-1 using ASTM method D3835.

The overcoat layer may be applied by dissolving the amorphous fluoropolymer in a perfluorinated solvent. The amorphous fluoropolymer is dissolved in the solvent from about 0.5 wt. % to about 9 wt. %, preferably about 1.0 wt. % to about 7 wt. %, more preferably about 1 wt. % to about 3 wt. %. Perfluorinated solvents include but are not limited to perfluoroalkanes, perfluoromethylhexane, perfluorodimethylcyclo hexane, perfluorocycloalkane and perfluorobranch-cycloalkane. The number of carbons in the perfluoroalkane ranges from about 2 to about 12, preferably from about 4 to about 8, even more preferably from about 6 to about 8. Perfluorinated alkanes include perfluorinated pentanes, hexanes, heptanes and octanes, FLUORINERT FC-75 (TM), available from 3M Commercial Chemical Division, Minneapolis, Minn. and perfluoro-2-alkyltetrahydrofurans, such as perfluoro-2-butyltetrahydrofuran, available from PCR Inc., Gainesville, Fla.

The overcoat layer solution may be applied to the imaging member by conventional coating techniques. Typical application techniques include spraying, dip coating, roll coating, wire-wound rod coating, and the like. The thickness of the overcoat ranges from about 0.5 to about 5 microns. Drying of the deposited coating may be effected by any suitable conventional technique such as oven drying, infrared radiation drying, air drying, vacuum drying and the like to remove substantially all of the solvent utilized in applying the coating. A preferred method for drying the overcoat layer is to air dry the coating followed by heat drying.

In embodiments of the invention, a primer is applied to the imaging member that allows the overcoat layer to adhere to the imaging member in a uniform manner. The primer may preferably comprise a fluorinated alkylsilane. The primer may be applied by dissolving about 0.5 wt % to about 2.0 wt %, more preferably, about a 1 wt. % to about 1.5 wt. %, even more preferably about 1 wt. % to about 1.25 wt. % fluorinated alkylsilane in a perfluorinated solvent. Solvents useful for dissolving the fluorinated alkylsilanes may be the same solvents used to dissolve the amorphous fluoropolymer in the overcoat layer described above. Fluorinated alkylsilanes useful in the primer layer include 1H,1H,2H,2H-perfluorooctyltriethoxysilane and 1 H, 1 H,2H,2H-perfluorodecyltriethoxysilane.

The fluorinated alkylsilane in the primer may form a layer of film over the imaging member. The primer may be applied to the electrophotographic imaging member and dried in the same manner as the overcoat layer described above. The thickness of the primer layer is about 0.025 to about 0.5 microns.

In an embodiment of the invention, the overcoat layer and the primer can be applied to the imaging member at the same time. For example, the amorphous fluoropolymer of the overcoat layer and the fluorinated alkylsilane of the primer can be dispersed together in the same solvent, or simultaneously sprayed onto the imaging member. A solution containing both the amorphous fluoropolymer and the fluorinated alkylsilane can be applied to the imaging member in one application.

The amorphous fluoropolymers used in the overcoat layer of the present invention provide numerous unique properties to the imaging member. These properties include being soluble in special solvents while remaining chemically resistant to most solvents and process chemicals. The amorphous fluoropolymer can be solution cast to form thin coatings in a submicron thickness range. The overcoat layer provides outstanding optical clarity and light transmission (IR to visible to UV range). The overcoat layer does not deteriorate when exposed to light, has a very low refractive index, is usable in optical devices when exposed to higher temperatures and chemicals and possesses a low dielectric constant. The overcoat layer exhibits good mechanical properties, dimensional stability, rigidity at high temperatures, machinability, processing versatility, creep resistance and resistance to deformation. The overcoating displays very little thermal expansion through a wide range of temperatures. The coatings made with amorphous fluoropolymers have acceptable UV stability and transmission, low moisture sensitivity and absorption. Further, the amorphous fluoropolymer will not react with corotron effluents to produce a conductive surface layer, thereby avoiding footprint deletions.

In addition to the electrophotographic imaging member described above, the overcoat layer can be used to coat an image-bearing dielectric member useful in ionography.

The imaging member according to the present invention can be used in an imaging process. A latent electrostatic image is formed on the imaging member. The latent image is developed with electrostatically attractable marking particles to form an image and the image is transferred to a receiving member. The electrostatically attractable marking particles can be in a dry toner or they can be in a liquid developer.

The invention will further be illustrated in the following, non-limitative examples, it being understood that these examples are intended to be illustrative only.

EXAMPLES

A commercially available photoreceptor belt from a Xerox 1075 copier is used in testing of the overcoat layer.

COMPARATIVE EXAMPLES 1–3

A 9"×12" piece of photoreceptor is cut from the photoreceptor described above. Comparative Example 1 is not treated with a primer layer or an overcoat layer. Comparative Example 2 is coated with a primer layer of 1H,1H,2H,2H-perfluorooctyltriethoxysilane (PFOTC). The PFOTC is prepared in a 1 wt % solution of FLUORINERT FC-75 (TM).

Comparative Example 3 is coated with a primer layer of PFOTC prepared as a 1% solution in ETOH. In Comparative Example 3, the solution dries in droplets after beading up and the coating is not satisfactory. Comparative Example 2 produces a satisfactory coating. The primer layer of both Comparative Examples 2 and 3 are coated with a Bird Film Applicator using the 0.001 inch bar.

EXAMPLES 1–5

Solutions of varying percentages of an amorphous fluoropolymer are prepared to make the overcoating layer of Examples 1–5. Specifically, 1, 3, 5, 7 and 10 percent solutions of TEFLON AF1600 (TM) dissolved in FC-75 FLUORINERT (TM) are prepared. All solutions are put in a glove box to equilibrate to a temperature of 27.5° C. This is done to determine if any differences are due to viscosity instead of temperature variations. The solubility of each solution is acceptable. Example 5, the 10% solution, is extremely viscous.

The solutions are coated on sections of the photoreceptor according to Comparative Example 2, i.e., with a primer layer of PFOTC in FC-75 FLUORINERT (TM). Examples 1 and 2, the 1% and 3% solutions, are coated onto the photoreceptor using a 0.001 inch bar. Example 3, the 5% solution, is coated with a 0.0025 inch bar. Example 4, the 7% solution, is coated with a 0.003 inch bar.

After coating, the pieces of photoreceptor are air dried for approximately three hours to prevent blistering from the charge transport Layer. Then the samples are dried for five minutes at 100° C. and five minutes at 135° C. No blistering or other surface defects are observed.

The examples are tested using a flat plate scanner to determine if the samples would discharge or produce residuals. Examples 4 and 5 produce residuals of greater than 500 volts.

Four samples are selected for repetitive cycling testing. The samples are Comparative Examples 1–2 and Examples 1–2. FIGS. 1–4 are graphs of the testing of Comparative Examples 1–2 and Examples 1–2, respectively. The samples are taped to an aluminum drum that has a circumference of 30 inches. The samples are rotated under a charge corotron that deposits negative charge on the surface and then rotated under a series of electrostatic voltmeters to monitor surface potential as a function of time. The sample is then passed under an erase lamp to remove the surface potential, under an electrostatic voltmeter to determine how much volatge remains (residual potential), and returned to the charge device to initiate another cycle. The drum rotates once per second. The residual potential is indicated by the lowest line marked with x's. The surface potentials after charge are the three parallel lines in the center of the graphs marked with squares, circles and triangles. The separation of these lines is the loss of surface potential in the dark (dark decay). The spike at cycle 70 was a computer error that appears in all samples and is not characteristic of the samples. All numbers are zero for that one entry.

Figure 2:
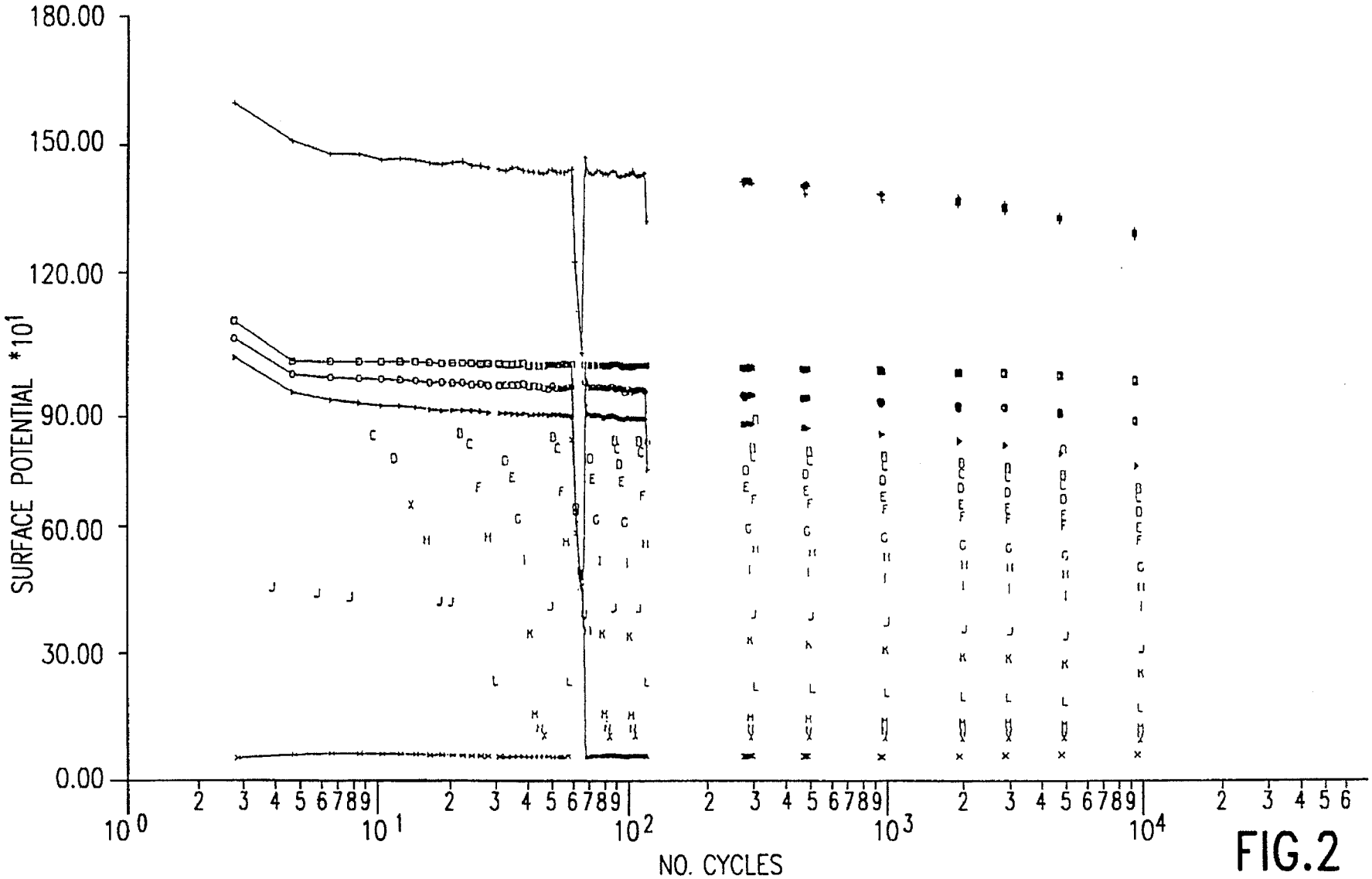
FIG. 2 is a graph of the surface potential of an imaging member according to Comparative Example 2.
Figure 3:
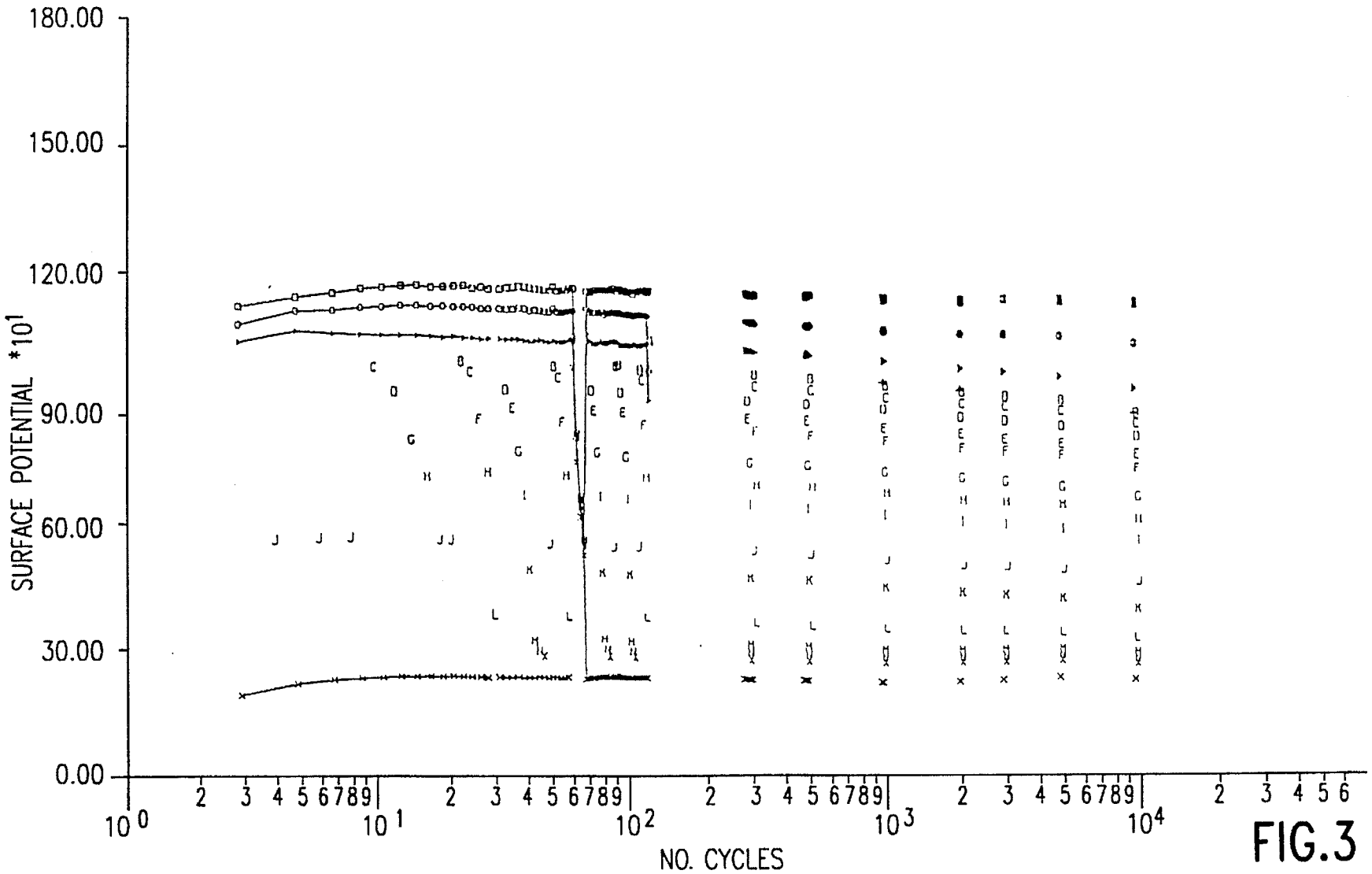
FIG. 3 is a graph of the surface potential of an imaging member according to Example 1.
Figure 4:
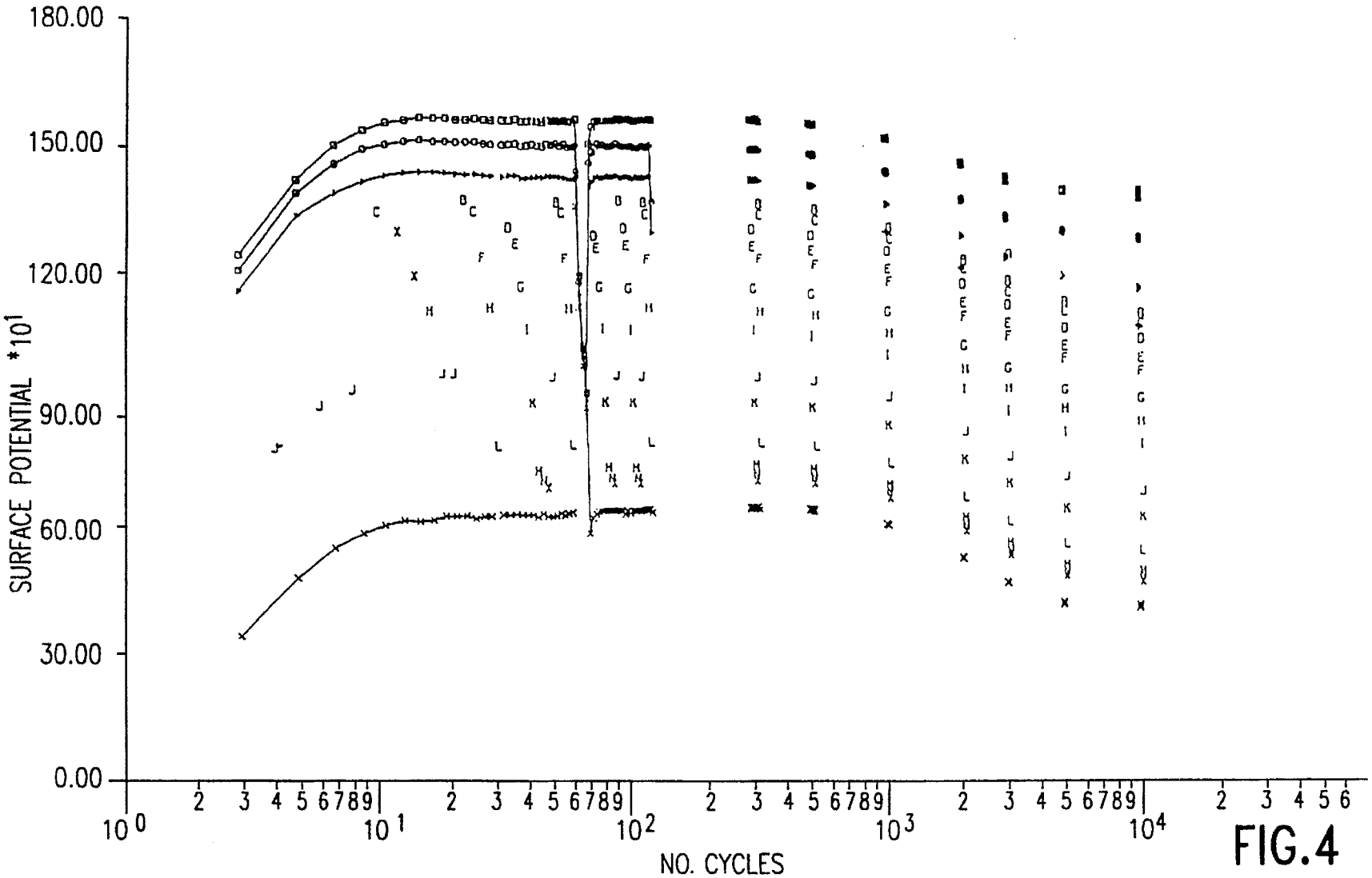
FIG. 4 is a graph of the surface potential of an imaging member according to Example 2.

The results show that the primer layer, FIG. 2, does not produce a change in either the residual potential or the dark decay. Example 1, FIG. 3, which has the thinnest layer, produces about 250 volts of residual potential but this remains constant for the 10,000 cycle test and could be used in copy machine. The dark decay is not by the overcoat. FIG. 4 (example 2) has a residual potential that changes with cycling. This device would require a control system with an electrostatic voltmeter and a variable developer bias to provide stable image quality. The dark decay remains constant, all of the other voltages are riding on top of the residual potential.

To test the overcoating's ability to resist moisture, moisture droplets are placed on Comparative Example 1 and Example 4. The water droplet completely beads up on the surface of Example 4. In contrast, the water droplet lays on the surface of Comparative Example 1 and does not bead up. These same water droplets are blown off the surface to test for poor wetability. The water droplet is easily blown off the surface of Example 4. This indicates good protection from moisture. In comparison, the water droplet on the surface of the uncoated photoreceptor did not bead up as much as on the coated sample and could not be completely removed with an air blast. This indicates that the surface does not repel liquids and moisture as readily as the coated sample.

Although the invention has been described with reference to specific preferred embodiments, those skilled in the art will recognize that variations and modifications may be made therein which are within the spirit of the invention and within the scope of the claims.

What is claimed is:

1. An imaging member comprising a dielectric layer capable of retaining an electrostatic latent image and an overcoat layer comprising an amorphous fluoropolymer.

2. The imaging member according to claim 1, wherein said dielectric layer is photoconductive.

3. The imaging member according to claim 1, further comprising a primer for said overcoat layer.

4. The imaging member according to claim 3, wherein said primer is in a primer layer.

5. The imaging member according to claim 3, wherein said primer is in said overcoat layer.

6. The imaging member according to claim 3, wherein said primer comprises a fluorinated alkyl silane.

7. The imaging member according to claim 6, wherein said fluorinated alkyl silane comprises 1H,1H,2H,2H-perfluorooctyltriethoxysilane.

8. The imaging member according to claim 1, wherein said amorphous fluoropolymer comprises fluorinated (ethylenic/cyclo oxyaliphatic substituted ethylenic) copolymer.

9. A method for overcoating an imaging member including a dielectric layer capable of retaining an electrostatic latent image, comprising applying an overcoat layer including an amorphous fluoropolymer onto said imaging member.

10. The method according to claim 9, wherein said amorphous fluoropolymer comprises fluorinated (ethylenic/cyclo oxyaliphatic substituted ethylenic) copolymer.

11. The method according to claim 9, wherein said overcoat layer is applied in a solution comprising a perfluorinated solvent.

12. The method according to claim 11, wherein said perfluorinated solvent comprises at least one member selected from the group consisting of perfluoroheptane and perfluoro-2-butyltetrahydrofuran.

13. The method according to claim 11, wherein said amorphous fluoropolymer comprises about 1 to about 3% by wt. of said solution.

14. The method according to claim 9, further comprising applying a primer onto said imaging member.

15. The method according to claim 14, wherein said primer is applied in a primer solution comprising a fluorinated alkyl silane and a perfluorinated solvent.

16. The method according to claim 15, wherein said fluorinated alkyl silane comprises 1H,1H,2H,2H-perfluorooctyltriethoxysilane.

17. The method according to claim 15, wherein said perfluorinated solvent comprises at least one member selected from the group consisting of perfluoroheptane and perfluoro-2-butyltetrahydrofuran.

18. The method according to claim 15, wherein said primer solution comprises about 1% to about 1.25% by wt. of said fluorinated alkyl silane.

19. The method according to claim 15, further comprising drying said primer and said overcoat layer at room temperature followed by heating.

20. The method according to claim 10, wherein said overcoat layer further comprises a primer.

21. An imaging process comprising:

a) forming a latent image on an imaging member according to claim 1;

b) developing said latent image with electrostatically attractable marking particles to form a developed image; and c) transferring said developed image to a receiving member.

22. The process according claim 21, wherein said imaging member is an electrophotographic imaging member.

23. The process according to claim 21, wherein said imaging member is an ionographic imaging member.

24. The process according to claim 21, wherein said electrostatically attractable marking particles are in a liquid developer.

* * * * *